US005552253A

United States Patent [19]

Kovacs et al.

[11] Patent Number: 5,552,253

[45] Date of Patent: Sep. 3, 1996

[54] MULTIPLE LAYER PHOTORECEPTOR FOR COLOR XEROGRAPHY

[75] Inventors: Gregory J. Kovacs, Mississauga, Canada; G. A. Neville Connel, Cupertino, Calif.; Ah-Mee Hor; Zoran D. Popovic, both of Mississauga, Canada

[73] Assignee: Xerox Corporation, Stamford, Conn.

[21] Appl. No.: 422,205

[22] Filed: Mar. 31, 1995

[51] Int. Cl.[6] ..... G03G 5/043

[52] U.S. Cl. ..... 430/57; 430/54

[58] Field of Search ..... 430/42, 54, 57

[56] References Cited

U.S. PATENT DOCUMENTS 3,704,121 11/1972 Makino et al. ..... 430/54

5,230,974 7/1993 Pai et al. ..... 430/54

*Primary Examiner*—John Goodrow

*Attorney, Agent, or Firm*—William Propp

[57] ABSTRACT

A two photoconductive stack photoreceptor has an electrically conductive substrate upon which are two photoconductive stacks with each photoconductive stack sensitive to or accessible to a different wavelength of light. After charging of the photoreceptor, areas of the photoreceptor are exposed to no light beams, a first light beam, a second light beam or both light beams which allows different toners to be deposited on the photoreceptor in response to the remaining areas of charges. This two photoconductive stack photoreceptor produces a color xerographic printing system. The photoreceptor can also have multiple photoconductive stacks.

18 Claims, 6 Drawing Sheets

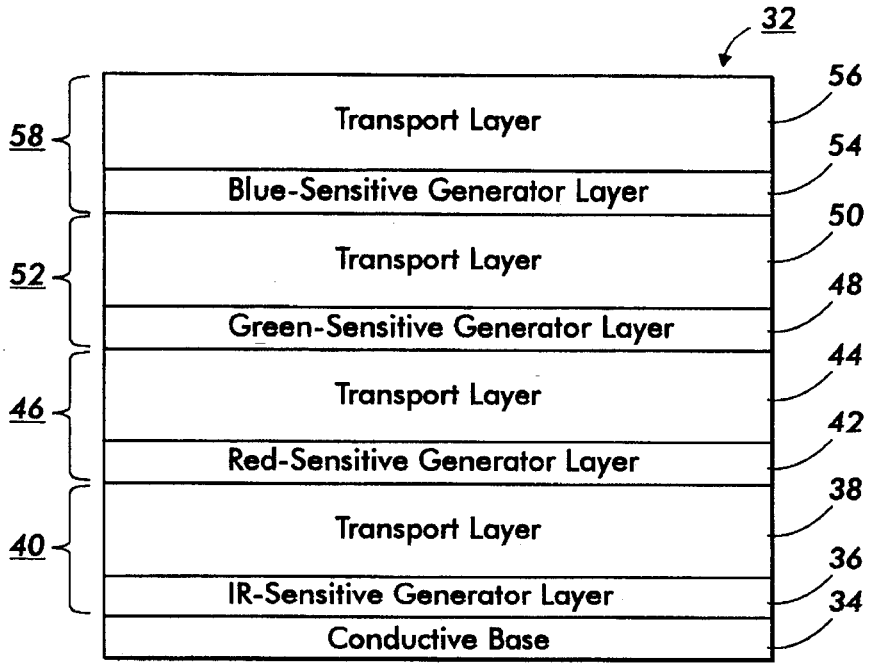
FIG. 3
FIG. 4
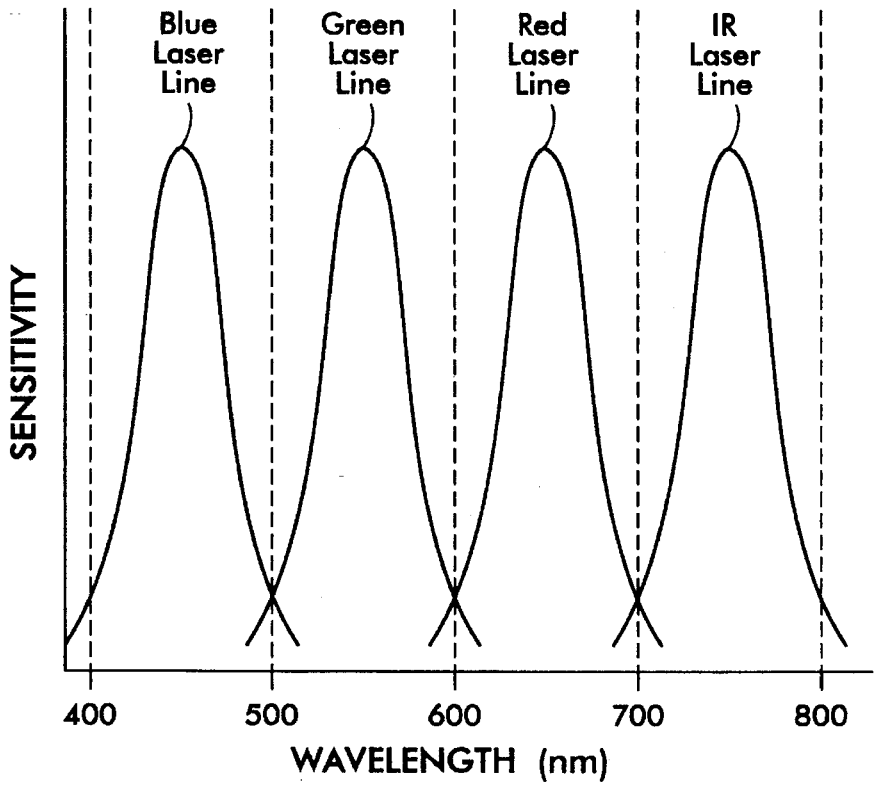

MULTIPLE LAYER PHOTORECEPTOR FOR COLOR XEROGRAPHY

CROSS-REFERENCE TO RELATED APPLICATION

This application contains subject matter that is related to subject matter of U.S. patent application Ser. No. 07/987,885, filed Dec. 9, 1992, U.S. Pat. No. 5,347,303, granted Sep. 13, 1994, U.S. patent application Ser. No. 08/000,349 now U.S. Pat. No. 5,347,303, filed Jan. 4, 1993, and U.S. patent application Ser. No. 08/343,068, pending filed Nov. 21, 1994, all commonly assigned to the same assignee herein and all herein incorporated by reference.

BACKGROUND OF THE INVENTION

This invention relates to a multiple layer photoreceptor for color xerography, and, more particularly, to a multiple photoconductive layer photoreceptor with each photoconductive layer sensitive or accessible to a different wavelength of light.

The formation and development of electrostatic latent images on surfaces of photoconductive imaging members, commonly referred to in the art as photoreceptors, is well known. In these systems, and in particular in xerography, the xerographic plate (or drum or belt) containing a photoconductive member is imaged by first uniformly electrostatically charging its surface, followed by exposure to a pattern of activating electromagnetic radiation, such as light, which selectively dissipates the surface charge in the illuminated areas of the photoconductive layer causing a latent electrostatic image to be formed in the non-illuminated areas. This electrostatic latent image may then be developed to form a visible image by depositing toner particles (optionally combined with carrier liquid or carrier particles) on the surface of the photoconductive layer. The resulting visible toner image can then be transferred to a suitable receiving member such as paper. This imaging process may be repeated many times with reusable photoconductive layers.

Examples of photoconductive imaging members include photoreceptors comprised of inorganic materials and organic materials, layered devices of inorganic or organic materials, composite layered devices containing photoconductive substances dispersed in other materials, and the like.

Current layered organic photoreceptors consist of a conductive substrate and two main active layers: (1) a thin charge generating layer containing a light-absorbing pigment, and (2) a thicker charge transport layer containing electron donors or acceptors in a polymer binder. The electron donor or acceptor molecules (e.g. triaryl diamines or fluorenones) provide hole or electron transport properties, while the electrically inactive polymer binder provides mechanical properties, such as film forming, adhesion binding, flexibility and resistance to wear.

The charge transport layer can alternatively be made from a charge transport polymer such as poly(N-vinylcarbazole) which is electron transporting or polysilylene or polyether carbonate which are hole transporting, wherein the charge transport properties are incorporated in the mechanically robust polymer. These photoconductive members can optimally include a charge blocking and/or adhesive layer between the charge generating layers and the conductive substrate. Additionally, they may contain protective overcoatings and the substrate may comprise a nonconductive layer and a conductive layer.

In a preferred photoreceptor, the photoreceptor surface is charged to a negative polarity by a corona device and discharged by visible or infrared light or radiation to form a charge pattern or image. The light is primarily absorbed by the pigment in the charge generating layer which photogenerates the charge carriers. The positive charges in this pigment or charge generating layer are injected into the charge transport layer (a hole transport layer) and transported to the surface of the charge transport layer, thereby discharging the layers.

In photoreceptors of this type, the photogenerating material generates electrons and holes when subjected to light. The blocking layer prevents the holes in the conductive ground plane from passing into the generator layer from which they would be conducted to the photoreceptor surface thus inhibiting surface charging and tending to erase any latent image formed there. The blocking layer, however, permits electrons generated in the generator layer to pass to the conductive ground plane, thus preventing an undesirably high electric field from building up across the generator layer upon cycling the photoreceptor.

More advanced xerographic copiers, duplicators and printers reproduce or print in color. These color systems typically require repeated passes of the photoreceptor through the xerographic system. These xerographic systems present color alignment problems and reduce the speed to produce a color copy or print.

In a negative charging photoreceptor, negative corona ions are deposited on the surface of the photoreceptor. The photoreceptor itself consists of a hole transport layer on top of a photogenerating layer on top of a conductive substrate. Thin adhesive and hole blocking layers may be used between the conductive substrate and photogenerating layer. Light absorbed in the photogenerating layer results in the promotion of an electron from the valence to the conduction band. The electron in the conduction band is now free to move through this band in response to applied electric fields. The promoted electron has left a positively charged hole in the valence band which is also free to move in response to applied electric fields. Therefore, the hole will move to the top of the photogenerator layer to the interface with the transport layer and the electron will move to the bottom of the photogenerator layer to the interface with the conductive substrate. The hole will then be injected into the transport layer and propagate through it in response to the applied field of the surface ions until it reaches the top of the transport layer and neutralizes a negative surface ion. (Hole injection from the generator layer to the transport layer is equivalent to electron injection from the Highest Occupied Molecular Orbital of the transport layer to the valence band of the photogenerator.) The electron in the conduction band at the bottom of the generator layer is injected into the grounded conductive substrate to neutralize the positive charge induced there by the negative surface ions.

It is an object of this invention to provide a photoreceptor with multiple stacked photogenerator-transport layer pairs wherein light absorbed in a given generator layer induces charge transport or discharge through the associated transport layer only and not through other generator or transport layer components of the multilayered photoreceptor.

It is another object of this invention to provide a negative charging photoreceptor with electron transporting hole blocking photogenerator layers which act as rectifiers to prevent hole transport coming through the underlying transport layer from passing through the photogenerator layer.

SUMMARY OF THE INVENTION

In general each photoconductive layer consists of a charge generator layer and a charge transport layer and to allow for this eventuality will, henceforth, be referred to as a photoconductive stack. However, the word stack will also encompass the possibility that the generator-transport layer pair are collapsed into a single layer. In accordance with the present invention, a two photoconductive stack photoreceptor has an electrically conductive substrate upon which are two photoconductive stacks with each photoconductive stack sensitive to or accessible to a different wavelength of light. After charging of the photoreceptor, areas of the photoreceptor are exposed to no light beams, a first light beam, a second light beam or both light beams which allows different toners to be deposited on the photoreceptor in response to the remaining areas of charges. This two photoconductive stack photoreceptor produces a color xerographic printing system. The photoreceptor can also have multiple photoconductive stacks.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 3 is a schematic illustration of the cross-section side view of a four photoconductive stack photoreceptor formed according to the present invention.

FIG. 4 is a schematic illustration of the wavelength sensitivity of a multiple photoconductive stack photoreceptor versus the wavelength range of the multiple wavelength laser structure for the four photoconductive stack photoreceptor of FIG. 3 formed according to the present invention.

DESCRIPTION OF THE PREFERRED EMBODIMENT

Figure 1:
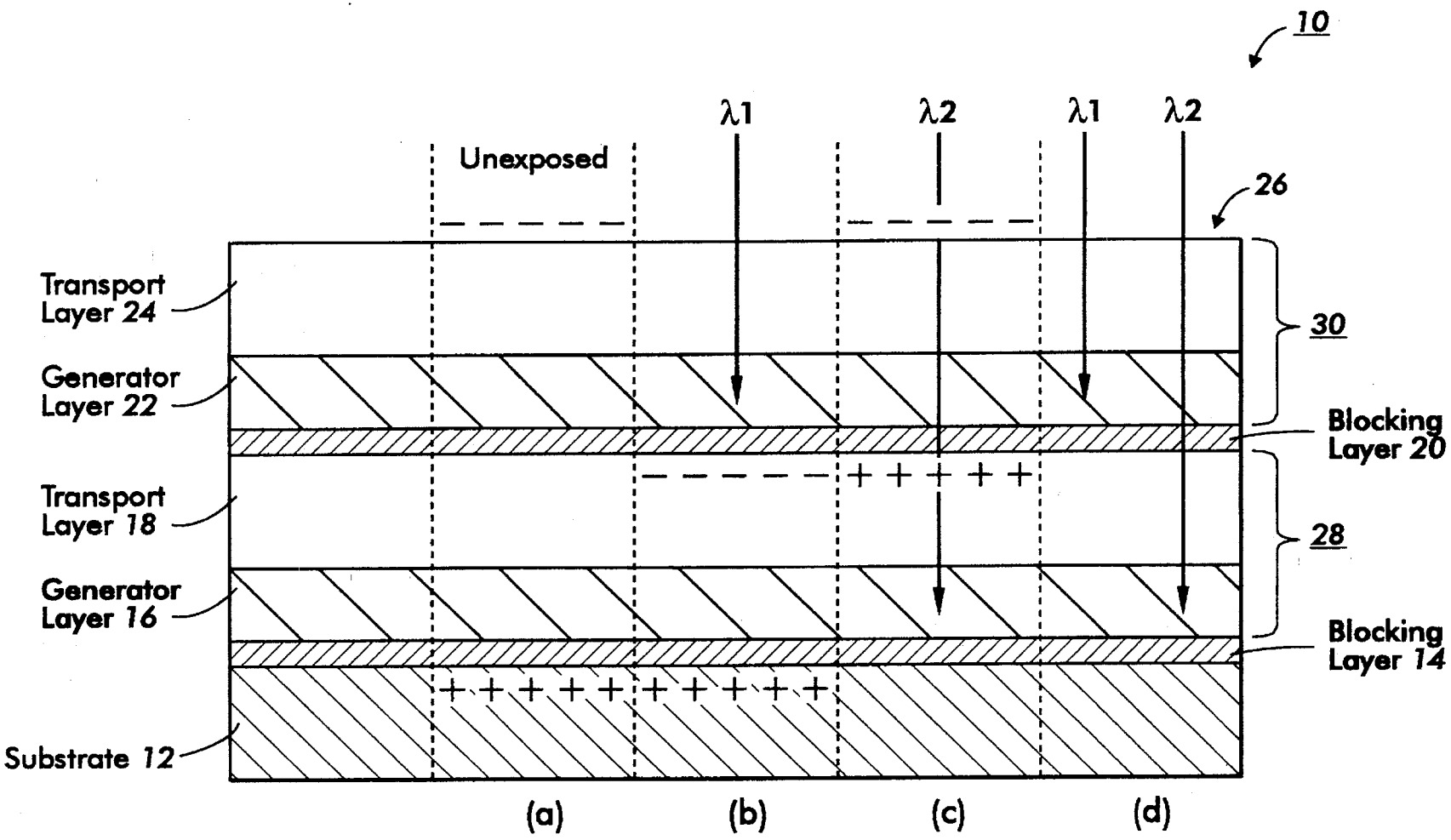
FIG. 1 is a schematic illustration of the cross-section side view of a two photoconductive stack photoreceptor formed according to the present invention.

Reference is now made to FIG. 1, wherein there is illustrated a multiple photoconductive stack photoreceptor 10 incorporating the invention which allows individual photoconductive stacks of a multiple photoconductive layer photoreceptor to be partially discharged, independently, with different wavelengths of light.

The two photoconductive stack photoreceptor 10 consists of an electrically conductive substrate 12 (which can be a metallic drum or plastic belt with conductive coating), a charge blocking layer 14 on top of the conductive substrate 12, the first charge generator layer 16 on top of the charge blocking layer 14, the first charge transport layer 18 on top of the first generator layer 16, an optional second charge blocking layer 20 which can be on top of the first charge transport layer 18, the second charge generator layer 22 on top of the second charge blocking layer 20, and the second charge transport layer 24 on top of the second charge generator layer 22. The surface 26 of the photoreceptor is on top of the second charge transport layer 24. The first or lower photoconductive stack 28 of the two stack photoreceptor 10 consists of the first charge generator layer 16 and the first charge transport layer 18. The second or upper photoconductive stack 30 of the two photoconductive stack photoreceptor 10 consists of the second charge generator layer 22 and the second charge transport layer 24.

The two stack photoreceptor is sensitive to two different wavelengths. One wavelength of light discharges only the lower or first charge generator layer 16 and the first charge transport layer 18 of the two stack photoreceptor 10 while the other wavelength of light discharges only the second or upper charge generator layer 22 and the second charge transport layer 24.

The lower generator layer 16 is sensitive to a wavelength of light to which the upper generator layer 22 is transparent. The upper generator layer 22, on the other hand, is sensitive to a light wavelength for which the layer has a very high optical density. Therefore, this light wavelength can not reach the lower photoconductive stack 28 and lead to the discharge of the lower charge generator layer 16 and first charge transport layer 18 due to this high optical density of the upper generator layer 22.

Typically, the lower photoconductive stack 28 responds to longer wavelengths of light than the upper photoconductive stack 30. But materials for the photoconductive stacks might be found where this is not absolutely necessary.

In the illustrative example of FIG. 1, the two photoconductive stack photoreceptor 10 consist of a flexible electrically conductive substrate 12 which may be aluminized polyester. The substrate has any effective thickness, typically from about 6 to about 250 microns, and preferably from about 50 to about 200 microns, although the thickness can be outside of this range. The charge blocking layer 14 generally consists of a thin silane layer which is about 10 nm thick.

For negatively-charged photoreceptors, a suitable hole blocking layer 14 should be capable of forming a barrier to prevent hole injection from the conductive substrate 12 to the opposite photogenerator layer 16. However, this blocking layer should allow electron transport in the opposite direction from the generator layer 16 to the conductive substrate 12. This charge blocking layer would be an electron blocking layer for positively charged photoreceptors which allows holes from the generator layer 16 of the photoreceptor to migrate into the conductive substrate 12 but prevents electrons from moving the other way on photoreceptor charging.

Upon the charge blocking layer 14 is a hydroxy gallium phthalocyanine (HOGaPc) first or lower generator layer 16 of approximately 0.1 to 1 microns thickness, a first or lower transport layer 18 of N,N'-diphenyl-N,N'-bis(3"-methylphenyl)-(1,1"-biphenyl)- 4,4'-diamine (TPD) in polycarbonate which is hole transporting and approximately 15 microns thick, a second charge blocking layer 20 of polyvinyl butyral (PVB) of 0.01 to 0.1 microns thickness, a benzimidazole perylene (BZP) second or upper generator layer 22 of approximately 0.1 to 1 microns thickness, a second or upper transport layer 24 of TPD in polycarbonate which is hole transporting and approximately 15 microns thick.

The hydroxy gallium phthalocyanine generator layer should be thin enough to maintain low dark decay and the benzimidazole generator layer should be thick enough to be opaque to the wavelength used to discharge it. Benzimidazole perylene is known to be coatable to opaque thicknesses while maintaining low dark decay.

In the case of a negative charging photoreceptor with hole transporting transport layers, the transport layer 24 supports the injection of photogenerated holes from the charge generator layer 22 and allows the transport of these holes through the transport layer to selectively discharge the surface charge upon the surface 26 of the photoreceptor 10 in those areas where light of wavelength $\lambda_1$ has been absorbed in the upper generator layer 22. In the case where light of wavelength $\lambda_2$ is absorbed in the lower generator layer 16, electron-hole pairs are generated in this layer 16. Electrons move downward under the action of the applied field toward the conductive substrate and pass through the hole blocking layer 14 to annihilate the induced positive charges in the conductive substrate. Holes move upward under the action of the same field and are injected from the generator layer 16 into the hole transport layer 18. These holes move to the top of the transport layer 18 and are stopped at the interface of transport layer 18 and hole blocking layer 20. In the case of negative charging, the transport layers 18 and 24 in FIG. 1 are both hole transporting and the blocking layers 14 and 20 are both hole blocking. The charge transport layer not only serves to transport holes but also serves to protect the charge generator layer from abrasion or chemical attack.

Figure 2:
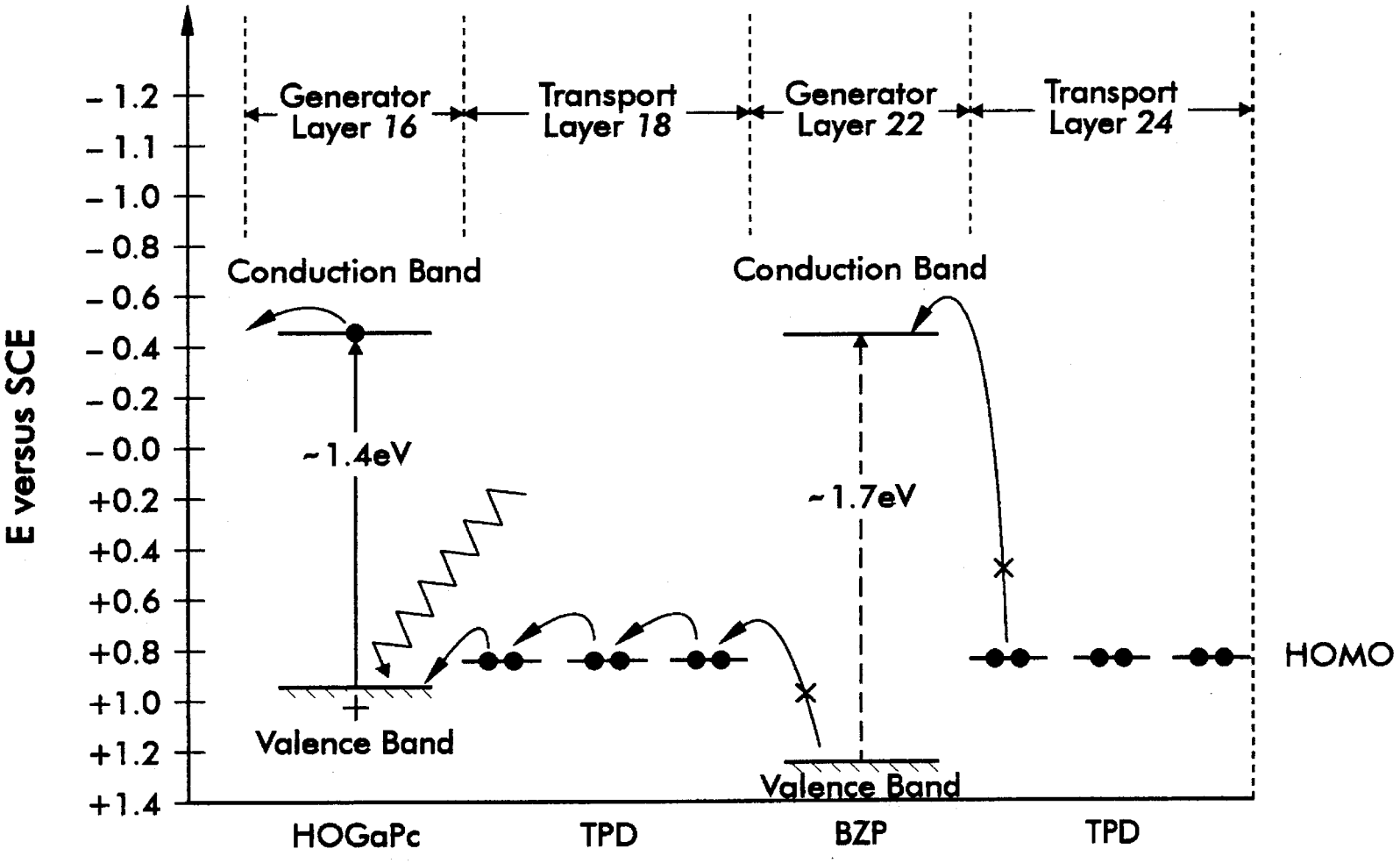
FIG. 2 is a schematic illustration of photogeneration of an electron and a hole in the lower infrared sensitive photogenerator layer, transport of the hole through the lower transport layer and injection of the electron into the conductive substrate of the two photoconductive stack photoreceptor of FIG. 1.

The wavelength to which the lower photoconductive stack 28 is sensitive will therefore discharge only the lower charge generator layer 16 and lower charge transport layer 18. The hole blocking layer 20 prevents the injection of holes from transport layer 18. While the second blocking layer 20 and second charge generator layer 22 are shown as discrete separate layers in FIG. 1, the functions of these two layers could, in fact, be combined into a single layer. This can be achieved if the generator layer 22 has hole blocking properties of its own. Benzimidazole perylene (BZP) is such a material which readily blocks hole injection. The hole blocking properties of BZP is illustrated in FIG. 2 and is a result of the fact that the valence band of BZP is much lower in energy than the HOMO of the hole transporting molecule. The energy barrier which must be surmounted to move an electron from the valence band of BZP to the HOMO of TPD is the barrier which prevents hole injection from TPD to BZP. Therefore, BZP possesses its own hole blocking properties.

The hole is not injected into the upper photogenerator layer because of the energy barrier between the valence band of the photogenerator layer and the Highest Occupied Molecular Orbital of the hole transporting material. Similarly, a hole is not injected from the upper photogenerator layer to the upper transport layer because of the energy barrier between the HOMO of the transport material and the conduction band of the upper photogenerator layer. The energy levels of the various valence bands, conduction bands and HOMO's are shown on an energy scale relative to the Saturated Calomel Electrode (SCE)in FIG. 2.

Alternatively, if the upper generator layer 22 does allow hole injection and transport it would be necessary to introduce the optional charge blocking layer 20 on top of the first transport layer 18, and below the second generator layer 22. The additional charge blocking layer may require a separate coating step but with multilayer coating techniques could potentially be done without the additional coating step.

For this illustrative example, the first generator layer 16 is infrared sensitive and the second generator layer 22 is red sensitive and the two wavelengths of the light beam source are in the red (at 670 nm) and the infrared (at 830 nm). The general requirement is that each charge generator layer is sensitive to only one of the two different wavelengths of the laser source but not sensitive to the other wavelength or each charge generator layer can only be accessed by one of the two wavelengths.

The multiple photoconductive stack photoreceptor 10 allows individual photoconductive stacks of the multiple photoconductive stack photoreceptor to be discharged, independently, with different wavelengths of light. If the charge transport layers between the charge generator layers are hole transporting, then the charge generator layers which are sandwiched by the charge transport layers must display rectifying behavior, i.e. must block hole injection upward and must readily allow electron injection downward. Electron injection downward must occur from these generator layers with no charge buildup at the lower interface of the generator layers. Alternatively, a blocking layer at the lower interface of the sandwiched generator layers can achieve the same effect of decoupling the discharge of the individual transport layers. This decoupling of the discharge enables the multiple level xerographic development needed for color xerography.

The charge transport layer transports holes which are generated in the photoconductive photogenerator layer and are blocked by the next shorter wavelength charge generator layer or by a separate charge blocking layer. The movement of holes through a hole transport layer reduces the surface voltage in the affected areas of the photoreceptor but does not necessarily remove the surface charge. Hole transport through the top half of the photoreceptor in section (b) of FIG. 1 has reduced the surface voltage by 50% and has also annihilated the surface charge. Hole transport through the bottom half of the photoreceptor in section (c) of FIG. 1 again reduces the surface voltage by 50% but leaves the surface charge intact.

The upper generator layer 22 displays rectifying behavior (i.e. hole blocking-electron injecting behaviour) in FIG. 2. Hole blocking can be achieved by a material whose valence band lies considerably below that of the HOMO (highest occupied molecular orbital) of the hole transport molecule, as shown in FIG. 2.

As holes approach the upper generator layer 22 from below, their transport is blocked due to the inability of valence electrons in the upper generator layer 22 to jump up to the empty HOMO state of the charge transport molecule. The electrochemically measured values of the relevant energy levels in FIG. 2 are as follows: HOGaPc—valence band~+0.95 V (E½ ox.), TPD—HOMO~+0.85 V (E½ ox.), BZP—conduction band—0.42 V (E½ red.) After holes are created by the absorption of IR photons in the valence band of the HOGaPc and transported to the interface of the first generator layer 16 and the first transport layer 18, electrons from the HOMO's of TPD molecules at the interface will be injected to fill these holes. This injection readily occurs since the electrons move downhill in energy from the HOMO in TPD to the valence band of HOGaPc. This electron injection from the HOMO to the valence band is equivalent to hole injection from the valence band to the HOMO. Electrons in HOMO's of neighboring TPD molecules then move under the action of the applied field and hop onto the holes in the HOMO's of TPD molecules which have given up electrons to the valence band of the HOGaPc. This electron hopping in the HOMO's of the TPD layer toward the HOGaPc layer is equivalent to hole transport in the opposite direction toward the BZP layer. The end result is the production of holes (electron vacancies) in the HOMO's of TPD molecules at the first transport layer/second generator layer interface. Since the valence band of the second generator layer 22 is much lower than the HOMO of the TPD molecules, this energy barrier prevents electron hopping from the valence band of the second generator layer 22 to fill the holes in the HOMO's of the TPD molecules at the interface of the first transport layer and the second generator layer. In other words, this barrier prevents hole injection from the first transport layer 18 into the second generator layer 22 and hence into the second transport layer 24.

The energy barrier is the dominant mechanism for blocking of hole transport through the second generator layer 22. However, another possibility is that hole injection into the pigment in the second generator layer 22 does occur but that the holes are then trapped in the second generator layer 22. Trapping then could be the mechanism blocking hole transport. Hole transport blocking could also be caused by a combination of the two mechanisms. In this case, the energy barrier would be low enough to allow a certain amount of hole injection but the injected holes would then not be transported through the second generator layer 22 due to charge trapping.

Returning to FIG. 1, the special multiple photoconductive stack/multiple wavelength photoreceptor 10 can use infrared sensitive pigments such as phthalocyanines for the lower generator layer 16 and visible sensitive pigments such as perylenes as the upper generator layer 22. Perylenes are known to be good electron transporters and poor hole transporters and are therefore ideally suited to provide the required electron blocking property of the upper generator layer 22 without the introduction of the second blocking layer 20.

The classes of materials mentioned here are only an illustration and other materials like squaraines, azo pigments, etcetera, can also be found useful in a similar fashion. The illustrative example assumes an organic multiple photoconductive stack photoreceptor. It is also feasible to design a similar inorganic photoreceptor (i.e., based on a—Se, $As_2Se_3$, a—Si and Ge, Si—Ge alloys, Si—C alloys, or any other inorganic materials suitable for xerographic photoreceptors).

The substrate 12 can be opaque, translucent, semitransparent, or transparent, and can be of any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. In addition, the substrate can comprise an insulative layer with a conductive coating, such as vacuum-deposited metallization on plastic, such as titanized or aluminized Mylar® polyester, wherein the metallized surface is in contact with the bottom photoreceptor layer or any other layer such as a charge injection blocking or adhesive layer situated between the substrate and the bottom photoreceptor layer.

In this illustrative embodiment, examples of suitable red light sensitive pigments include perylene pigments, dibromoanthranthrone, crystalline trigonal selenium, beta-metal free phthalocyanine, azo pigments, and the like, as well as mixtures thereof. Examples of suitable infrared sensitive pigments include hydroxygallium phthalocyanine, X-metal free phthalocyanine, metal phthalocyanines such as vanadyl phthalocyanine, chloroindium phthalocyanine, chloroaluminum phthalocyanine, copper phthalocyanine, magnesium phthalocyanine, titanyl phthalocyanine, and the like, squaraines, such as hydroxy squaraine, and the like as well as mixtures thereof. Examples of suitable charge transport materials include diamine molecules, pyrazoline molecules, substituted fluorene molecules, oxadiazole molecules, hydrazone molecules, carbazole phenyl hydrazone molecules, vinyl-aromatic polymers, oxadiazole derivatives, trisubstituted methanes, and 9-fluorenylidene methane derivatives.

The generator and transport layers can be deposited by vacuum evaporation or solvent coating upon the substrate by means known to those of ordinary skill in the art.

The manufacturing process of the multiple photoconductive stack photoreceptor can be solution coating, vacuum evaporation, plasma discharge deposition, a combination of these processes, or any other process found useful for xerographic photoreceptor manufacturing. The photoreceptor can be, as noted previously, either in the form of a flexible belt or a drum.

The reverse case of electron transporting charge transport layers and electron blocking charge generator layers is equally valid, though materials exhibiting these properties currently have poorer performance, particularly with regard to the electron transporting function than do hole transport materials. Trinitro fluorenone is one of the best electron transporting materials but the transport properties are far inferior to the hole transporting properties of TPD.

During exposure from light beams from a raster output scanner as shown in FIG. 1, the 670 nm wavelength of the first light beam would be entirely absorbed in the upper opaque benzimidazole perylene generator layer 22 of the photoreceptor 10. Exposure with the 670 nm beam would therefore discharge the benzimidazole perylene generator layer 22 and upper transport layer 24. None of the 670 nm light beam would reach the lower hydroxy gallium phthalocyanine generator layer 16 so that the hydroxy gallium phthalocyanine layer 16 and lower transport layer 18 would remain fully charged.

The 830 nm wavelength of the second light beam insures that the beam will pass completely through the upper benzimidazole perylene generator layer 22 without effecting any discharge of the benzimidazole perylene layer 22 or upper transport layer 24. However, the hydroxy gallium phthalocyanine layer 16 is very sensitive to the 830 nm wavelength and exposure with this wavelength will discharge the lower hydroxy gallium phthalocyanine generator layer 16 and the lower transport layer 18.

The details of the imaging process to expose the image in a pass of the photoreceptor 10 are shown in FIG. 1. There are four resultant areas on the photoreceptor after the first pass by the imaging station: (a) the unexposed areas which retain the original surface voltage, (b) the areas exposed with 670 nm which are discharged to roughly one-half of the original surface voltage, (c) the areas exposed with 830 nm which are also discharged to roughly one-half of the original surface voltage, and (d) the areas exposed with both 670 nm and 830 nm which are fully discharged. While only three voltage levels are present on the photoreceptor at this stage immediately after exposure, there will be four distinctly different areas on the surface 26 of the photoreceptor 10 after xerographic development.

While the surface voltages in regions (b) and (c) are roughly equal after exposure, they have been formed by exposing different photoreceptor layers and different development processes will be applied to the two regions, as explained in the cross-referenced applications. The surface charge levels attract oppositely charged colored toner in a xerographic system. Both positive and negative polarities of toner and both CAD (charged area development) and DAD (discharged area development) development are used in the color xerographic system based upon the photoreceptor 10. Appropriate development biases are used at each step. Scavengeless development techniques would be used to avoid contamination of developer housings by already deposited toner of another color.

As mentioned previously, photoreceptors with the same characteristics as the photoreceptor 10 in FIG. 1 can be envisaged which utilize electron transport layers and photoconductive materials which trap electrons or which incorporate respective electron blocking layers. The operation of an electron transporting system uses positive corona surface charge as shown in FIG. 2. Electron transporting materials have a Lowest Unoccupied Molecular Orbital (LUMO) which lies below the conduction bands of the photogeneration materials. An electron promoted to the conduction band of the first photogenerator layer 16 by light absorption can then be readily injected to the lower energy level of the LUMO. However, when this electron arrives at the second photogenerator layer 22, it will be unable to surmount the energy barrier and jump up to the conduction band of the second photogenerator layer 22 and electron blocking will occur. Current materials technology would indicate that hole transporting systems are advantaged over electron transporting systems since hole transporting materials have far superior properties to the best electron transporting materials.

The photoreceptor can have more than two photoconductive stacks and can respond to more than two different wavelengths of light. A photoreceptor which would respond to three or more wavelengths and lead to discharge of one of the three or more charge transport layers follows a similar design and similar operation to the photoreceptor 10 of FIG. 1.

In the multiple photoconductive stack photoreceptor, all of the charge transport layers should transport holes only and all of the generator layers should transport electrons only. The lowest or first generator layer should respond to the longest wavelength. The second or next generator layer above the first generator layer should respond to a shorter wavelength light beam, block holes and also absorb the shorter wavelength sufficiently so that it can not reach the lowest or first generator layer and discharge the first charge transport layer. The third generator layer, situated on top of the second transport layer should respond to still shorter wavelengths and also block hole transport (either due to property of the pigment or by the presence of another blocking layer).

In principle, the photoreceptor can consist of any number of generator and transport layers with the successive generator layers being shifted in absorption to shorter wavelengths, blocking holes and having sufficient optical density to prevent undesirable discharge of lower layers. Light beams of the proper wavelength would discharge just one of many charge transport layers, which is the essential requirement of a multiple layer photoreceptor and the resulting color xerographic system.

The photoreceptor belt 32, as shown in FIG. 3, consists of a flexible electrically conductive substrate 34. The substrate has any effective thickness, typically from about 6 to about 250 microns, and preferably from about 50 to about 200 microns, although the thickness can be outside of this range. Each photoconductive stack in FIG. 3 consists of two layers, i.e. a charge generator layer and a charge transport layer. Charge blocking layers, not shown, may be positioned between adjacent photoconductive stacks.

Upon the substrate 34 is a first, infrared-sensitive, generator layer 36 approximately 0.1 to 1 microns thick and a first transport layer 38 of TPD in polycarbonate (N,N'-diphenyl-N,N'-bis(3"-methylphenyl)-(1,1'-biphenyl)-4,4'-diamine) which is hole transporting and approximately 15 microns thick. The first generator layer 36 and the first transport layer 38 form a first photoconductive stack 40.

Upon the first generator and transport layers is a second, red-sensitive, generator layer 42 approximately 0.1 to 1 microns thick and a second transport layer 44 of TPD in polycarbonate which is hole transporting and approximately 15 microns thick. The second generator layer 42 and the second transport layer 44 form a second photoconductive stack 46.

Upon the second generator and transport layers is a third, green-sensitive, generator layer 48 approximately 0.1 to 1 microns thick and a third transport layer 50 of TPD in polycarbonate which is hole transporting and approximately 15 microns thick. The third generator layer 48 and the third transport layer 50 form a third photoconductive stack 52.

And upon the third generator and transport layers is a fourth, blue-sensitive, generator layer 54 approximately 0.1 to 1 microns thick and a fourth transport layer 56 of TPD in polycarbonate which is hole transporting and approximately 15 microns thick. The fourth generator layer 54 and the fourth transport layer 56 form a fourth photoconductive stack 58.

The generator and transport layers can be deposited by vacuum evaporation or solvent coating upon the substrate by means known to those of ordinary skill in the art.

Light beams of different wavelengths or colors will be absorbed in different layers of the photoreceptor. Therefore the red wavelength light beam will be absorbed in the red sensitive layer, the green wavelength light beam in the green sensitive layer, the blue wavelength light beam in the blue sensitive layer, and the IR wavelength light beam in the IR sensitive layer. This may be achieved by the extended absorption edge scheme shown in FIG. 7 and described previously.

Alternately as shown in FIG. 4, each generator layer may be sensitive to only one of the wavelengths from one of the light beams of a multiple wavelength laser source while being transparent to the other wavelengths from the other light beams of the multiple wavelength laser source. The sensitivity of each photoconductive stack of the photoreceptor is separated as the wavelengths of the light beams from the source are separated. In order for the discharge to occur only in the required photoconductive stack, the sensitivity of each of the stacks must be well separated and cover only a narrow range of wavelengths. The blue light beam should be absorbed only by the blue sensitive photoconducting pigment and not by the green, red or IR sensitive layers. The spectral sensitivity of the photoconductive stacks should match the output of the laser light sources as closely as possible. Ideally, each of the photoconductive stacks should be excited by only one of the light beams and should be transparent to the other light beams.

Figure 5:
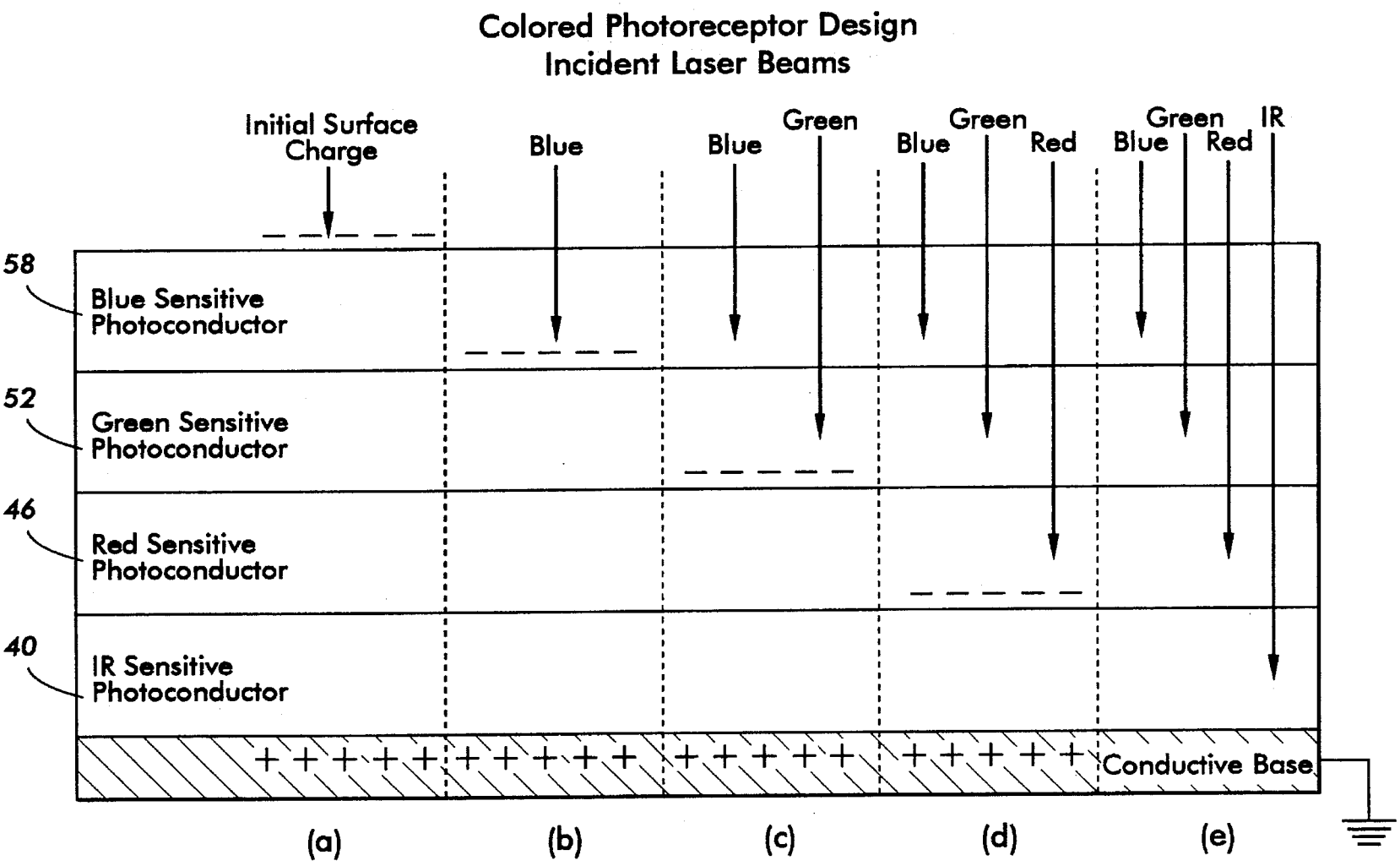
FIG. 5 is a schematic illustration of the cross-section side view of certain exposures of the four photoconductive stack photoreceptor of FIG. 3 formed according to the present invention.

The multiple photoconductive stack photoreceptor is discharged to different levels depending on the wavelengths of incident light beams as shown in FIG. 5. Five of the possible discharge patterns are illustrated on the photoreceptor: (a) the unexposed areas which retain the original surface voltage, (b) the top photoconductive stack exposed only to the blue wavelength light, (c) the two top photoconductive stacks exposed only to the blue wavelength light and the green wavelength light, (d) the three top photoconductive stacks exposed only to the blue wavelength light, the green wavelength light and the red wavelength light, and (e) the fully discharged areas of all four photoconductive stacks exposed to the blue wavelength light, the green wavelength light, the red wavelength light, and the infrared wavelength light. However, discharge to each voltage level can in general be achieved in a plurality of ways.

Depending upon the number of colors and color combinations desired for printing, one could use a dual photoconductive stack photoreceptor in combination with a dual wavelength light source, as taught in co-pending patent application Ser. No. 07/987,885, filed Dec. 9, 1992, commonly assigned as the present application and herein incorporated by reference, a three photoconductive stack photoreceptor in combination with a three wavelength light source or a four photoconductive stack photoreceptor in combination with a four wavelength light source.

The dual photoconductive stack photoreceptor and dual wavelength system is capable of producing 3 (SPOT) color images. The three photoconductive stack photoreceptor and three wavelength system is capable of producing 4 (SPOT) color images. The four photoconductive stack photoreceptor, four wavelength system is capable of producing full color process images of all six primary colors and black and white. SPOT color is such that only a single color of toner is deposited at any one point of the image, i.e. there is no development of one color toner on top of another. In process color images, cyan, magenta, yellow and black toners are generally used with a color on color scheme wherein all three combinations of any two of the cyan, magenta and yellow colorants on top of each other are used along with the individual cyan, magenta, yellow and black colorants alone.

Figure 6:
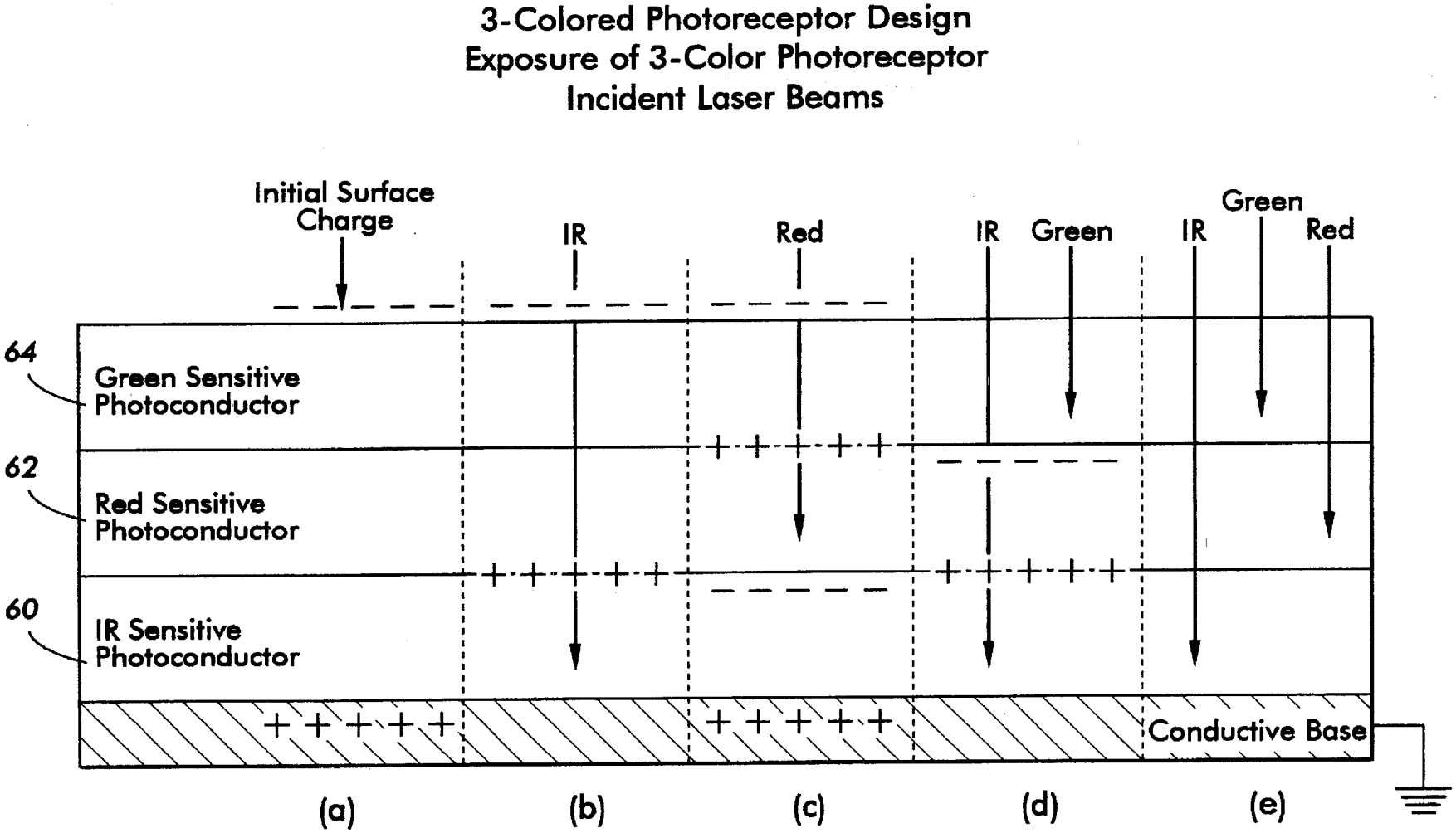
FIG. 6 is a schematic illustration of certain exposures of an alternate three photoconductive stack embodiment of the multiple photoconductive stack photoreceptor formed according to the present invention.

Four SPOT color imaging can be done with a three color photoreceptor, three wavelength system. FIG. 6 shows five different exposure combinations of IR, red and green light beams on a three photoconductive stack photoreceptor whose three photoconductive stacks 60, 62 and 64, are sensitive to IR, red and green light respectively. The initial charging voltage is 1200 V on the three photoconductive stack photoreceptor and the four voltage levels are equally spaced at 400 V intervals. The five different exposure combinations will result in four different colored areas plus an uncolored white area on the final print. Area (a) is unexposed and remains at 1200 V; area (b) is exposed with IR wavelength light only and discharged to 800 V; area (c) is exposed with red wavelength light only and discharged to 800 V; area (d) is exposed with IR wavelength light and green wavelength light and discharged to 400 V; and area (e) is exposed with IR wavelength light, red wavelength light and green wavelength light and discharged to 0 V.

Figure 7:
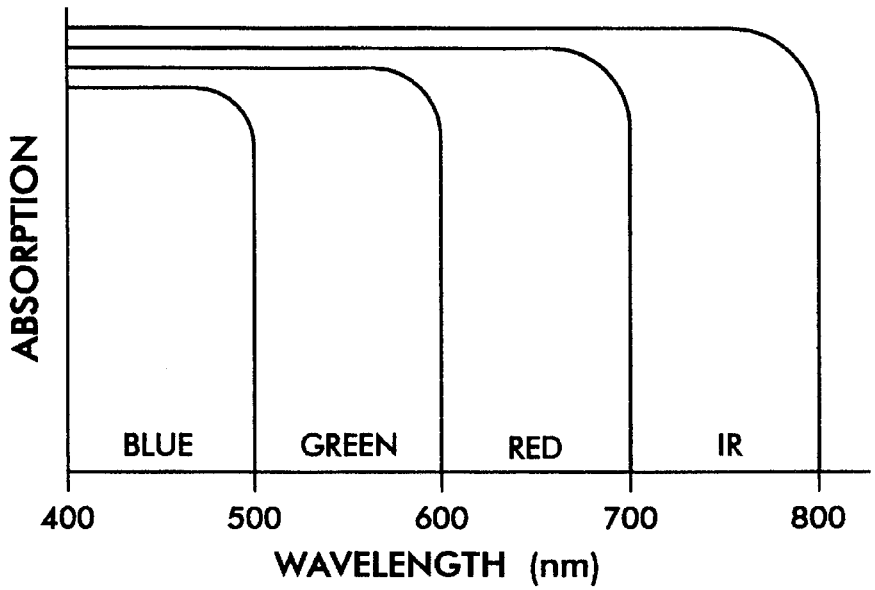
FIG. 7 is a schematic illustration of the wavelength sensitivity of a multiple photoconductive stack photoreceptor versus the wavelength range of the multiple wavelength laser structure of an alternate embodiment of the multiple photoconductive stack photoreceptor.

An alternate embodiment of the photoreceptor could have the generator layers sensitive to more than one color or sensitive over a wider range of wavelength. As shown in FIG. 7, one photoconductive stack would be sensitive to just blue wavelength light, another photoconductive stack would be sensitive to blue wavelength light and green wavelength light, another photoconductive stack would be sensitive to blue wavelength light, green wavelength light, and red wavelength light, and the last photoconductive stack would be sensitive to blue wavelength light, green wavelength light, red wavelength light and infrared wavelength light.

Figure 8:
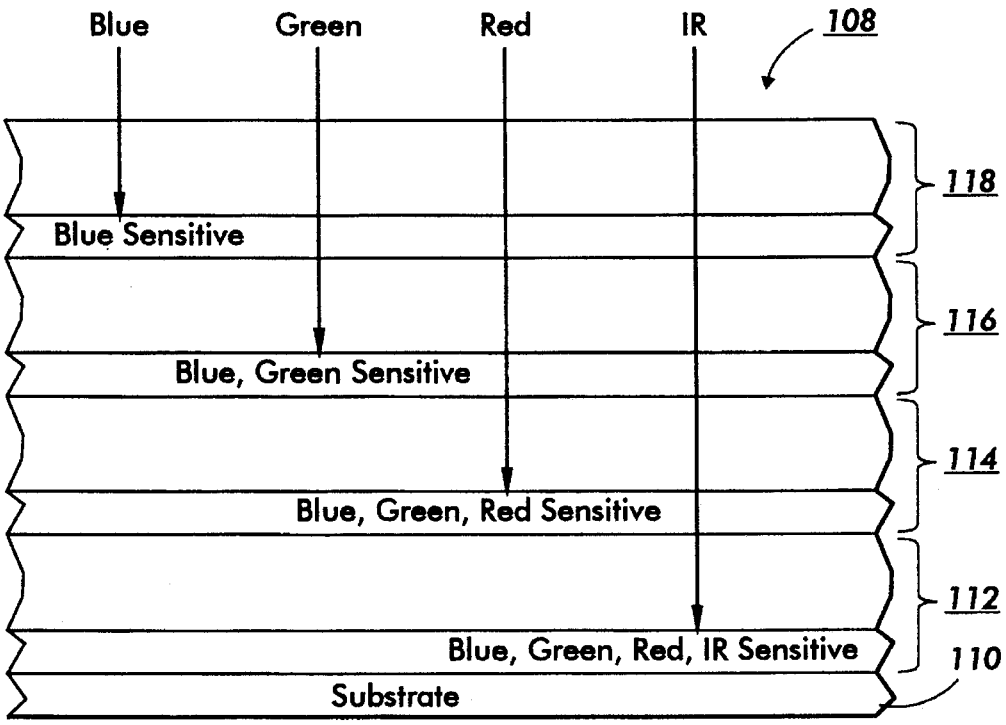
FIG. 8 is a schematic illustration of the cross-section side view of the exposure of the multiple photoconductive stack photoreceptor of FIG. 7 formed according to the present invention.

The photoreceptor 108 as seen in FIG. 8 would have the conductive substrate 110 upon which is the first or lower photoconductive stack 112 sensitive to blue, green, red and infrared wavelength light, then the second or lower middle photoconductive stack 114 sensitive to blue, green, and red wavelength light, then the third or upper middle photoconductive stack 116 sensitive to blue and green wavelength light, then the fourth or upper photoconductive stack 118 sensitive to just blue wavelength light.

These stacks are piled such that the broadest sensitivity (IR sensitive) stack 112 is at the bottom of the photoreceptor 108, the next broadest is on top of this and so on to the top where the narrowest sensitivity (blue sensitive) stack 118 is situated. A light beam of a given wavelength is accessible to only one of the photoconductive stacks. A blue light beam is absorbed in the top photoconductive stack 118 and cannot reach any of the lower photoconductive stacks 116, 114, and 112 which could also be sensitive to it. Green light passes through the blue sensitive stack 118 and is absorbed in the second photoconductive stack 116 and prevented from reaching stacks 114 and 112 below which could also be sensitive to it. This pattern continues so that each wavelength is absorbed by only one photoconductive stack.

The substrate of the photoreceptor belt can be opaque, translucent, semitransparent, or transparent, and can be of any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. In addition, the substrate can comprise an insulative layer with a conductive coating, such as vacuum-deposited metallized plastic, such as titanized or aluminized Mylar® polyester, wherein the metallized surface is in contact with the bottom photoreceptor layer.

In this embodiment, examples of suitable red light sensitive pigments include perylene pigments, dibromoanthranthrone, crystalline trigonal selenium, beta-metal free phthalocyanine, azo pigments, benzimidazole perylene (BZP), and the like, as well as mixtures thereof. Examples of suitable infrared sensitive pigments include titanyl phthalocyanine, hydroxygallium phthalocyanine, X-metal free phthalocyanine, metal phthalocyanines such as vanadyl phthalocyanine, chloroindium phthalocyanine, chloroaluminum phthalocyanine, copper phthalocyanine, magnesium phthalocyanine, and the like, squaraines, such as hydroxy squaraine, and the like as well as mixtures thereof. Examples of blue sensitive material are amorphous selenium, methylene blue, anthracene and sulphur. Examples of green sensitive material are quinacridene, Se-Te alloys and pigments such as Pigment Red 122 (CI73915). Examples of suitable charge transport materials include diamine molecules, pyrazoline molecules, substituted fluorene molecules, oxadiazole molecules, hydrazone molecules, carbazole phenyl hydrazone molecules, vinyl-aromatic polymers, oxadiazole derivatives, tri-substituted methanes, and 9-fluorenylidene methane derivatives.

As shown, the materials usable in the generator layers of the multiple layer photoreceptor can be greatly expanded by considering not only materials with narrow, well-defined, absorption bands as shown in FIG. 4 but by also considering materials with wider absorption bands. The only requirement is that each wavelength or color of light beam discharges only one photoconductive stack of the photoreceptor. If each photoconductive stack is only accessed by one wavelength of light, then each wavelength is absorbed in a given photoconductive stack which prevents this light from reaching lower photoconductive stacks which may also be sensitive to that particular wavelength.

This general concept is illustrated in FIGS. 7 and 8. Combinations of the absorption schemes used in FIGS. 4 and 7 may also be used in the multiple photoconductive stacks of the photoreceptor. For example, the blue, red and IR wavelength sensitive photoconductive stacks would have wide absorption bands similar to those in FIG. 7 and the green sensitive photoconductive stack could have a narrow absorption band as shown in FIG. 4. The stacking order of the photoconductive layers in FIG. 8 is thus important since each wavelength of light must be stopped in the photoconductive stack where it is first absorbed and be prevented from reaching lower photoconductive stacks which are also sensitive to that wavelength. If each photoconductive stack is of the narrow absorption band type as shown in FIG. 4, then the order of the photoconductive stack piling does not matter.

Typically, the lower photoconductive stack responds to longer wavelengths of light than the upper photoconductive stack. But materials for the photoconductive stacks might be found where this is not absolutely necessary. The piling order of the stacks could be chosen arbitrarily if each photogenerator layer is sensitive only to a narrow wavelength band as shown in FIG. 4. Alternatively, the layers could be stacked with the shortest wavelength sensitivity layer on the bottom and the longer wavelength sensitivity layer on top if the absorption spectra followed a different pattern than shown in either FIG. 4 or FIG. 7. Such an absorption pattern would require that the absorption pattern of FIG. 7 be transposed. In FIG. 7, the absorption bands all cover the short wavelength region and have edges at progressively longer wavelengths. The transposed pattern would have the absorption bands all covering the larger wavelength regions with edges at progressively shorter wavelengths.

It should be noted that in each of the embodiments described each voltage level has been referred to as a single number. In actual practice, certain ranges about the given values will occur and the process latitudes must encompass these ranges. Discrete regularly spaced voltage values have been referred to in order to simplify the discussions.

Similarly, the wavelengths used in the embodiments are merely illustrative examples. In actual practice, certain wavelength ranges can be used and each color is not restricted to a single wavelength. The only criteria is that the wavelengths be sufficiently separated so that any given wavelength accesses only one of the photoreceptor stacks.

While the invention has been described in conjunction with specific embodiments, it is evident to those skilled in the art that many alternatives, modifications and variations will be apparent in light of the foregoing description. Accordingly, the invention is intended to embrace all such alternatives, modifications and variations as fall within the spirit and scope of the appended claims.

What is claimed is:

1. A two photoconductive stack photoreceptor for exposure to at least one first modulated beam at a first wavelength and at least one second modulated beam at a second wavelength, said second wavelength being different from said first wavelength, comprising:

an electrically conductive substrate upon which is a first photoconductive stack and a second photoconductive stack, said first photoconductive stack, adjacent to said electrically conductive substrate, being sensitive or accessible only to said first wavelength and said second photoconductive stack being sensitive or accessible only to said second wavelength, said first photoconductive stack and said second photoconductive stack each having a charge generator layer and a charge transport layer, wherein, after charging said photoreceptor, areas of said photoreceptor are exposed to neither beam, said first beam, said second beam, or both first beam and second beam for subsequently depositing toner on said photoreceptor in response to exposure of said areas of said photoconductive stacks to said beams and to the resulting discharge pattern.

2. The two photoconductive stack photoreceptor of claim 1 wherein said electrically conductive substrate, said first photoconductive stack and said second photoconductive stack comprise a photoreceptor belt.

3. The two photoconductive stack photoreceptor of claim 1 wherein said electrically conductive substrate, said first photoconductive stack and said second photoconductive stack comprise a photoreceptor drum.

4. The two photoconductive stack photoreceptor of claim 1 wherein said first photoconductive stack is sensitive in the infrared range and said second photoconductive stack is sensitive in the red range.

5. The two photoconductive stack photoreceptor of claim 1 wherein said first photoconductive stack consists of titanyl phthalocyanine and said second photoconductive stack consists of benzimidazole perylene.

6. The two photoconductive stack photoreceptor of claim 1 wherein said first photoconductive stack consists of hydroxygallium phthalocyanine and said second photoconductive stack consists of benzimidazole perylene.

7. The two photoconductive stack photoreceptor of claim 1 wherein said first wavelength is approximately 830 nm and said second wavelength is approximately 670 nm.

8. The two photoconductive stack photoreceptor of claim 1 wherein said first wavelength or said second wavelength or both said first and second wavelengths are a range of wavelengths.

9. The two photoconductive stack photoreceptor of claim 1 wherein the discharge due to absorption of light in a given stack is confined to the absorbing stack alone, due to the halting of the charge transport effecting the discharge at the interfaces bounding the stack.

10. A multiple photoconductive stack photoreceptor for exposure to at least one of a plurality of modulated beams at a plurality of wavelengths, each wavelength being different from each other wavelength, comprising:

an electrically conductive substrate upon which is a plurality of photoconductive stacks, each photoconductive stack being sensitive or accessible only to one of said plurality of wavelengths, each of said photoconductive stacks having a charge generator layer and a charge transport layer, wherein, after charging said photoreceptor, areas of said photoreceptor are exposed to none, one, less than a plurality or all of the plurality of beams for subsequently depositing toner on said photoreceptor in response to exposure of said areas of said photoconductive layers to said beams and to the resulting discharge pattern.

11. The multiple photoconductive stack photoreceptor of claim 10 wherein each of said plurality of photoconductive stacks is sensitive to only one of said plurality of wavelengths.

12. The multiple photoconductive stack photoreceptor of claim 10 wherein each of said plurality of photoconductive stacks may be sensitive to more than one of said plurality of wavelengths but each of said multiple photoconductive stacks is accessible to only one of said wavelengths said photoconductive stack is sensitive to.

13. The multiple photoconductive stack photoreceptor of claim 10 wherein said electrically conductive substrate and said plurality of photoconductive stacks comprises a photoreceptor belt.

14. The multiple photoconductive stack photoreceptor of claim 10 wherein said electrically conductive substrate and said plurality of photoconductive stacks comprises a photoreceptor drum.

15. The multiple photoconductive stack photoreceptor of claim 10 wherein said plurality of photoconductive stacks comprises four photoconductive stacks wherein a first photoconductive stack, adjacent to said electrically conductive substrate, is infrared wavelength sensitive, a second photoconductive stack is red wavelength sensitive, a third photoconductive stack is green wavelength sensitive, and a fourth photoconductive stack is blue wavelength sensitive, and said plurality of beams comprises four beams wherein a first beam is in the infrared range of wavelengths, a second beam is in the red range of wavelengths, a third beam is in the green range of wavelengths and a fourth beam is in the blue range of wavelengths.

16. The multiple photoconductive stack photoreceptor of claim 10 wherein said plurality of photoconductive stacks comprises three photoconductive stacks wherein a first photoconductive stack, adjacent to said electrically conductive substrate, is infrared wavelength sensitive, a second photoconductive stack is red wavelength sensitive, and a third photoconductive stack is green wavelength sensitive and said plurality of beams comprises three beams wherein a first beam is in the infrared range of wavelengths, a second beam is in the red range of wavelengths, and a third beam is in the green range of wavelengths.

17. The multiple photoconductive stack photoreceptor of claim 10 wherein one, less than a plurality or all of the plurality of said beams are a range of wavelengths.

18. The stacked photoreceptor structure of claim 10 wherein the discharge due to absorption of light in a given stack is confined to the absorbing stack alone, due to the halting of the charge transport effecting the discharge at the interfaces bounding the stack.

* * * * *